US008623797B2

(12) United States Patent
Watts et al.

(10) Patent No.: US 8,623,797 B2
(45) Date of Patent: Jan. 7, 2014

(54) BORON-CONTAINING LUBRICATING OILS HAVING IMPROVED FRICTION STABILITY

(75) Inventors: Raymond F. Watts, Long Valley, NJ (US); Joe R. Noles, Jr., Belle Mead, NJ (US); Keith R. Gorda, Little York, NJ (US); Kerry L. Cogen, Flemington, NJ (US)

(73) Assignee: Infineum International Limited, Oxfordshire (GB)

( * ) Notice: Subject to any disclaimer, the term of this patent is extended or adjusted under 35 U.S.C. 154(b) by 182 days.

(21) Appl. No.: 11/770,941

(22) Filed: Jun. 29, 2007

(65) Prior Publication Data

US 2009/0005276 A1 Jan. 1, 2009

(51) Int. Cl.
*C10M 133/16* (2006.01)
*C10M 125/26* (2006.01)

(52) U.S. Cl.
USPC ..... 508/543; 508/192

(58) Field of Classification Search
USPC ..... 508/192, 151, 185, 189, 186, 190, 263, 508/269, 543, 545, 546
See application file for complete search history.

(56) References Cited

U.S. PATENT DOCUMENTS

| | | | | | |
|---|---|---|---|---|---|
| 3,254,025 | A * | 5/1966 | Le Suer | ..... | 508/192 |
| 3,502,677 | A | 3/1970 | Le Suer | | |
| 4,105,571 | A | 8/1978 | Shaub et al. | | |
| 4,273,665 | A | 6/1981 | Braid et al. | | |
| 4,298,486 | A * | 11/1981 | Horodysky et al. | ..... | 508/190 |
| 4,857,214 | A * | 8/1989 | Papay et al. | ..... | 508/188 |
| 5,314,633 | A | 5/1994 | Ryer et al. | | |
| 5,441,656 | A * | 8/1995 | Ohtani et al. | ..... | 508/558 |
| 5,750,476 | A | 5/1998 | Nibert et al. | ..... | 508/291 |
| 5,840,662 | A | 11/1998 | Nibert et al. | ..... | 508/291 |
| 5,916,852 | A * | 6/1999 | Nibert et al. | ..... | 508/432 |
| 6,337,309 | B1 * | 1/2002 | Watts et al. | ..... | 508/291 |
| 6,613,722 | B1 * | 9/2003 | Watts et al. | ..... | 508/195 |
| 2003/0220206 | A1 | 11/2003 | Komiya et al. | | |

FOREIGN PATENT DOCUMENTS

| | | |
|---|---|---|
| EP | 1344814 | 9/2003 |
| JP | 2000-336386 | 12/2000 |
| JP | 2000-345181 | 12/2000 |
| JP | 2001-513140 | 8/2001 |
| JP | 2001-515099 | 9/2001 |
| JP | 2002-105478 | 4/2002 |
| JP | 2002-194376 | 7/2002 |
| JP | 2003-501514 | 1/2003 |
| JP | 2003-277785 | 10/2003 |

OTHER PUBLICATIONS

"Tribological properties of aqueous solution of imidazoline borates" Wear 253 (2002) 576-578.*

"A Novel Approach for Solid Phase Synthesis of Substituted Imidazoline and Bis-Imidazolines" J. Org. Chem 2001 66, 8673-8676 by Achyuta N. Acharya, John, M. Ostresh and Richard Houghten.*

C.V. Smalheer and R. Kennedy Smith, "Lubricant Additives", 1967, pp. 1-11.

* cited by examiner

*Primary Examiner* — Pamela H Weiss
(74) *Attorney, Agent, or Firm* — Kenyon & Kenyon LLP

(57) ABSTRACT

Lubricating oil compositions having excellent friction stability comprise a base lubricating oil, an oil soluble source of phosphorus and a defined polyalkylene polyamine-based friction modifier that has been reacted with a borating agent to convert at least one secondary amine group into the corresponding boric acid ester or boric acid salt.

3 Claims, No Drawings

BORON-CONTAINING LUBRICATING OILS HAVING IMPROVED FRICTION STABILITY

This invention relates to an additive composition useful for providing excellent friction stability to lubricating oils, particularly power transmitting fluids such as automatic transmission fluids (hereinafter referred to as "ATFs"), continuously variable transmission fluids ("CVTFs"), and double clutch transmission fluids ("DCTFs"), and more particularly useful for imparting excellent frictional characteristics to the fluid during high speed clutch engagements.

Further aspects include a method of imparting friction stability to such lubricating oils comprising the use therein of the additive composition, the use of the additive composition in lubricating oil for the purpose of improving friction stability, and other aspects as hereinafter defined.

The transmissions to which this invention is applicable are those transmissions that contain a lubricated wet clutch that is used under conditions of high energy dissipation. These types of applications include the clutches in an automatic transmission used to accomplish ratio or speed changes; wet starting clutches in automatic, continuously variable or double clutch transmissions; or clutches used in torque vectoring or inter-axle differential applications. These clutches can be characterized as having high differential speed between the two members of the clutch and high energy dissipation in the "engagement" or "lock up" of the clutch.

Thus, one additional aspect of the invention concerns a power transmission apparatus comprising a single or multiple plate clutch device lubricated by the power transmission fluid of the invention, wherein in use the clutch is employed under conditions of high energy, i.e. undergoing engagements at above speeds of about 500 rpm (revolutions per minute), and especially above 500 rpm.

A common goal of automobile builders is to produce vehicles that are more durable and perform more reliably over their service life. One aspect of increased durability and reliability is to produce vehicles that need a minimum of repairs during their service life. A second aspect is to have vehicles that perform consistently throughout this "lifetime". In the case of automatic transmissions, not only should the transmission not fail during the lifetime of the vehicle, but its shift characteristics should not perceptibly change over this period. Since shift characteristics of automatic transmissions are heavily dependent on the frictional characteristics of the ATF, the fluid needs to have very stable frictional performance with time, and therefore mileage. This aspect of ATF performance is known as friction stability. Currently many vehicle builders are moving to "fill-for-life" automatic transmission fluids, this trend further increases the need for friction stability of the ATF, since the fluid will no longer be replaced at 15,000 to 50,000 mile service intervals.

A common method for determining the friction durability of an ATF is through the use of an SAE #2 friction test machine. This machine simulates the high speed engagement of a clutch by using the clutch as a brake, thereby absorbing a specified amount of energy. The energy of the system is chosen to be equivalent to the energy absorbed by the clutch in completing one shift in the actual vehicle application. The machine uses a specified engagement speed, normally 3600 rpm, and a calculated inertia to provide the required amount of energy to the test clutch and fluid. The clutch is lubricated by the fluid being evaluated, and each deceleration (i.e., braking) of the system is termed one cycle. To evaluate friction stability many cycles are run consecutively. Increasing emphasis on friction stability by original equipment manufacturers (OEMs) has caused the total number of cycles required to demonstrate satisfactory friction durability to increase from several hundred in the 1980's to 10,000 or more in some current specifications. For example see the Ford MERCON® V Automatic Transmission Fluid for Service specification.

There are two methods of assessing improved friction durability. One is to maintain certain friction characteristics over a longer period of time (i.e. over more cycles). The second is to allow less change in each friction parameter over the course of the same number of cycles. Both methods provide indications that the vehicle shift characteristics will be consistent over a longer number of miles.

Friction control in a power transmission fluid such as an ATF, CVTF or DCTF is primarily the function of the friction modifiers in the fluid. However, the thermal and oxidative stresses under which such fluids are used in the transmission lead to additive degradation and thereby changes in fluid properties. Oxidation or thermal destruction of the friction modifiers is often first seen in the fluid as rising static friction. Rising static friction causes abrupt shifts which vehicle occupants can feel as a jerk or lurch as the shift completes. Rising static friction is a common mode of failure of power transmission fluids. In some circumstances, however, oxidation of friction modifiers can transform them into more active species. In these situations static friction can actually decrease during service. Lowering of static friction, while not normally an issue for the vehicle occupant, can lower the holding capacity of the clutches in the transmission. Lowering of holding capacity can cause the clutches to slip under high loads, e.g. towing or rapid acceleration, making them prone to overheat and ultimately to fail. Therefore the best power transmission fluids have extremely stable static friction levels that are well maintained with use.

Conventionally, there are two ways to improve friction stability of a power transmission fluid. One way is to increase the amount of friction modifier in the fluid. This has the desired effect of improving friction stability, by providing a higher reservoir of friction modifier in the oil, but increasing the amount of friction modifier has the undesirable secondary effect of lowering the friction coefficients of the fluid to undesirable levels, especially the static coefficient of friction. The second way is to improve the oxidation resistance of the fluid, through the concurrent use of oxidation inhibitor additives, particularly to reduce the generation of polar products of oxidation which thereafter compete with the friction modifiers for the friction surface. Reducing fluid oxidation therefore has the potential to improve long term control of friction.

U.S. Pat. Nos. 5,750,476 and 5,840,662 report that a combination of antioxidants, oil soluble phosphorus compounds, and specific low potency friction modifiers can confer outstanding friction durability to ATFs. These low potency friction modifiers are characterized by the fact that once a saturation concentration of the friction modifier is reached in the fluid, increasing the concentration causes no further reduction in the measured friction levels. Fluids can thus be treated with very high concentrations of these low potency friction modifiers to create a larger reservoir of additive in the oil and still exhibit satisfactory levels of friction. It is believed that as the low potency friction modifier molecules are consumed, through shearing or oxidation, there is always an ample concentration available to take their place on the friction surfaces. An oil-soluble phosphorus-containing compound must also be present to protect the system from wear.

However, such solutions by definition demand the use of high quantities of additive. A need exists for solutions which make more efficient use of chemical resources and are more cost effective.

Similarly, the additional requirement for oxidation inhibitors leads to more complex formulations, and the prospect of greater development and usage costs.

We have now found that greater thermal and oxidative stability can be conferred on one class of friction modifier, namely polyalkylene polyamine based friction modifiers, without any loss of its ability to control friction, by the reaction of at least one secondary amino group present in its polyamine moiety with a borating agent. Where more than one secondary amino group is present in the polyamine moiety, good stability can be achieved by borating all of the secondary amino groups present in the friction modifier.

Such friction modifiers show improved properties over existing solutions and provide a more cost-effective solution to the problem of friction durability in oils, especially in power transmission fluids.

In a first aspect, this invention relates to lubricating oil (and particularly to power transmission fluid) compositions comprising an oil soluble phosphorus containing compound and a polyalkylene polyamine-based friction modifier carrying at least one hydrocarbyl substituent, the, or each, hydrocarbyl substituent comprising between 6 and 30 carbon atoms, wherein at least one secondary amino group in the polyamine chain of the friction modifier has been reacted with a borating agent to form the corresponding is boric acid ester or boric acid salt.

More particularly, this invention relates to lubricating oil (and particularly to power transmission fluid) compositions comprising:

(a) a major amount of a lubricating oil; and (b) a friction stability improving effective amount of an additive combination comprising:

(i) a friction modifier comprising the reaction product of a borating agent (being boric acid, an alkyl boron or an ester of boric acid) with one or more compounds selected from the group of compounds (I), (II) and (III), where (I), (II), and (III) are represented by the structures:

(I)

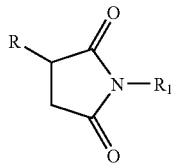

(II)

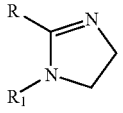

(III)

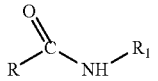

wherein:

R is a $C_6$ to $C_{30}$ alkyl or alkenyl group; $R_1$ is a polyalkylene polyamine group represented by structure (IV):

(IV)

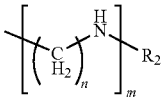

wherein n and m are each independently integers from 1 to 6; and $R_2$ is an alkyl or aryl group or their heteroatom containing derivatives, or is selected from the structures V, VI and VII below; and (V)

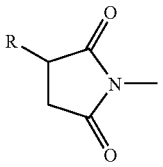

(VI)

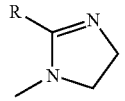

(VII)

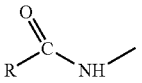

(ii) an oil-soluble phosphorus-containing compound.

In this latter embodiment, each secondary nitrogen in the structure IV of structures I, II and III respectively has been reacted with the borating agent to give rise to the corresponding boric acid salt or boric acid ester.

It should be noted that while the reaction products are postulated as simple adducts of boric acid ($H_3BO_3$), some of the boric acid may be present in polymeric or cyclic (metaborate) structures and that these more complex forms of boric acid are also within the scope of the term 'boric acid' as used in this specification.

Other aspects of the invention include the polyalkylene polyamine-based friction modifier (b) (i) per se as defined above; an additive composition comprising the friction modifier defined above in combination with an oil soluble phosphorus containing compound; a method of imparting friction stability to lubricating oils, comprising the use therein of a friction stability improving effective amount of the additive combination defined above; and the use, in lubricating oil, of the additive composition defined above, in an amount effective to improve the friction stability thereof.

Further aspects and embodiments of the invention will become apparent from the detailed description which follows.

DETAILED DESCRIPTION OF THE INVENTION

This invention concerns a method for improving the friction stability of lubricating oils, without disadvantageously lowering the coefficients of friction. It comprises the combined use in the oil of a friction modifier derived from a defined polyalkylene polyamine and an oil-soluble source of phosphorus. This combination of additives provides outstanding friction stability to lubricating oils, especially transmission fluids.

While the benefits of this invention are contemplated to be applicable to a wide variety of lubricating oils wherein friction modifiers are usefully employed (e.g., crankcase engine oils, etc.), particularly preferred compositions are power transmitting fluids, especially automatic transmission fluids (ATFs), continuously variable transmission fluids (CVTFs) and double clutch transmission fluids (DCTFs). Examples of other, less preferred types of power transmitting fluids included within the scope of this invention are gear oils, hydraulic fluids, tractor fluids, universal tractor fluids and the like. These power transmitting fluids can be formulated with a variety of additional performance additives and in a variety of base oils.

The Polyalkylene Polyamine-Based Friction Modifiers of the Invention

The preferred friction modifiers of the present invention are either produced from succinimides carrying at least one hydrocarbyl substituent wherein the or each hydrocarbyl substituent comprises between 6 and 30 carbon atoms and is preferably an alkenyl group or the fully saturated alkyl analog; or are produced from carboxylic amides having at least one alkenyl or alkyl chain comprising between 6 and 30 carbon atoms and being one or more structures formed from the reaction of the corresponding alkenyl: or alkyl carboxylic acids and polyalkylene polyamines.

The most preferred type of friction modifier is produced firstly by reaction of alkyl or alkenyl succinic anhydrides, the akyl or alkenyl substituents thereon being isomerized chains, with one or more polyalkylene polyamines, preferably one or more polyethylene polyamines. In such preferred materials, the isomerised chain is bonded to an α-carbon atom of the succinimide ring, giving rise to a two-branched substituent attached to the ring α-carbon atom via a tertiary carbon atom, as exemplified in the structure below for the alkenyl-substituted structure reacted with polyethylene polyamine:

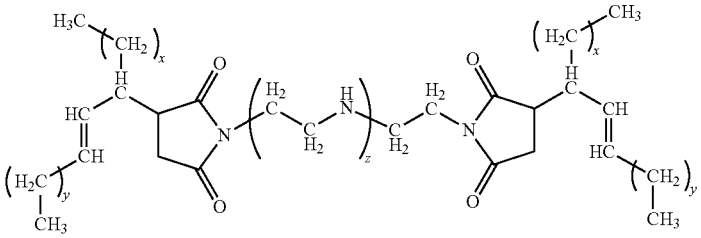

wherein x and y are independent integers whose sum is from 1 to 25, and z is an integer from 1 to 10.

Preparation of the isomerized alkenyl succinic anhydrides is well known and is described in, for example, U.S. Pat. No. 3,382,172. Commonly these materials are prepared by heating alpha-olefins with acidic catalysts to migrate the double bond to an internal position. This mixture of olefins (2-enes, 3-enes, etc.) is then thermally reacted with maleic anhydride. Typically olefins from $C_6$ (1-hexene) to $C_{30}$ (1-triacotene) are used. Suitable isomerized alkenyl succinic anhydrides of structure (I) include iso-decylsuccinic anhydride (x+y=5 in the above formula), iso-dodecylsuccinic anhydride (x+y=7), iso-tetradecylsuccinic anhydride (x+y=9), iso-hexadecylsuccinic anhydride (x+y=11), iso-octadecylsuccinic anhydride (x+y=13) and iso-eicosylsuccinic anhydride (x+y=15). Preferred materials are iso-hexadecylsuccinic anhydride and iso-octadecylsuccinic anhydride, for which especially good performance is seen.

The materials produced by this process contain one double bond (alkenyl group) in the alkyl chain. The alkenyl substituted succinic anhydrides may be easily converted to their saturated alkyl analogs by hydrogenation.

The isomerized-alkenyl or -alkyl substituted succinic anhydrides can thereafter be reacted with suitable amines to produce friction modifiers of the types shown in structure (I), from which the friction modifiers (b) (i) of the invention are thereafter formed by boration.

Alternatively to the isomerized-alkenyl or -alkyl succinic anhydrides, carboxylic acids possessing at least one alkenyl or alkyl chain comprising between 6 and 30 carbon atoms may be reacted with suitable amines to produce friction modifiers of the types shown in structures (II) and (III). Such acids are preferably alkyl or alkenyl acids comprising between 12 and 22 carbon atoms, and especially between 16 and 20 carbon atoms. The friction modifiers of the invention are thereafter formed by boration.

Suitable amines useful to produce the friction modifier of structures (I), (II) and (III) are represented by structure (XI):

(XI)

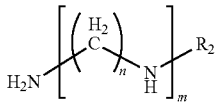

wherein n and m are each independently integers from 1 to 6 and $R_2$ is as previously defined.

The amines of the structure XI may in turn be produced from the reaction of primary polyamines. A particularly useful class of such amines are the polyalkylene polyamines of the general formula (XII), where (XII) is:

(XII)

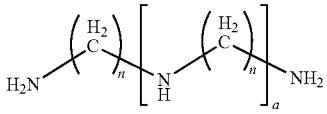

wherein a is an integer from 1 to 5, preferably 2 to 4; and each n is independently an integer from 1 to 6, preferably from 1 to 4.

Non-limiting examples of suitable polyamine compounds include: diethylene triamine, triethylene tetramine, tetraethylene pentamine and pentaethylene hexamine. Low cost mixtures of polyamines having from 5 to 7 nitrogen atoms per molecule are available from Dow Chemical Co. as Polyamine H, Polyamine 400 and Polyamine E-300.

Such polyamines may be reacted with the above-described succinic anhydrides substituted with alkenyl groups or their fully saturated alkyl analogs to form the structure I, or the above-described alkenyl or alkyl carboxylic acids to form structures II and III.

The preferred friction modifiers of this invention are normally prepared by heating the isomerized alkenyl succinic anhydride described above (or its saturated-alkyl analog) with the above polyamine and removing the water formed. However, other methods of preparation are known and can be used. The ratio of primary amine groups to succinic anhydride groups is usually 1 to 1. In the case of diamines or polyamines where the molecule is terminated on both ends with a primary amine, it may be desirable to react both terminal amine groups of the molecule with the substituted succinic anhydride giving materials of the following structure (XIII):

(XIII)

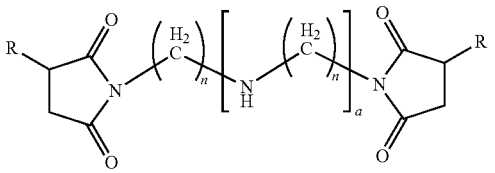

wherein R, a, and n are as previously defined.

The borating agents of the present invention are those materials capable of forming boric acid esters or salts with the secondary amine group(s) present on the friction modifier. Compounds useful in this regard include boric acid (including polymeric and cyclic forms of boric acid), alkyl boron compounds and esters of boric acid.

The borating agent preferred for use is boric acid.

The amount of boration can vary, but should be sufficient to give the effect of the invention. While it has been found that a minimum level of one equivalent of boron to each secondary nitrogen is sufficient to gain the benefits of the invention, higher amounts of boron are also effective and may be beneficial. Therefore, over-boration, i.e. more than one equivalent of boron per secondary nitrogen, is also included in the invention as disclosed in Example D above.

The preferred friction reducers of this invention are those produced by firstly reacting alkenyl succinic anhydrides with those polyamines (XI), and thereafter with boric acid. The most preferred products of this invention are those produced from reaction of the isomerized-alkenyl succinic anhydrides with polyamines (XII) which are then reacted with boric acid.

Whilst any effective amount of the friction modifier may be used in the various aspects of the invention, the treat rates of the friction modifiers are usually from about 0.1 to about 10, preferably 0.5 to 7, and most preferably from 1.0 to 5.0 weight percent in the lubricating composition.

Examples of the preparation of typical friction modifier materials of the invention are given below. These examples are intended for illustration, and the invention is not limited to the specific details set forth in the examples.

PREPARATIVE EXAMPLES

Example A

Preparation of the Isomerised Succinimide

Into a one liter round bottomed flask fitted with a mechanical stirrer, nitrogen sweep, Dean Starke trap and condenser was placed 352 gm (1.00 mole) of iso-octadecenylsuccinic anhydride (ODSA from Dixie Chemical Co.). A slow nitrogen sweep was begun, the stirrer started and the material heated to 130° C. Immediately thereafter, 95 gm (0.50 moles) of commercial tetraethylene pentamine was added slowly via an addition funnel to the hot stirred iso-octadecenylsuccinic anhydride. The temperature of the mixture was increased to 150° C. where it was held for two hours. During this heating period 10 ml. of water (~50% of theoretical yield) were collected in the Dean Starke trap. The flask was cooled to yield the product. Yield: 435 gm. Percent nitrogen: 8.1.

Example B

Preparation of the Isomerised Succinimide

The same procedure was followed as in Example A, except that the following amounts were used: iso-octadecenylsuccinic anhydride, 700 gm (2.0 moles), and diethylenetriamine, 103 gm (1.0 mole). The water recovered was 32 ml. Yield: 765 gm. Percent nitrogen: 5.5.

Example C

Preparation of the Borated Isomerised Succinimide of the Invention

Into a one liter round bottomed flask fitted with a mechanical stirrer, nitrogen sweep, Dean Starke trap and condenser was placed 765 gm (1.0 mole) of the product of Example B. A slow nitrogen sweep was begun, the stirrer started and the material heated to 100° C. Approximately 5 ml of water was added followed by 62 gm (1.0 mole) of boric acid. Once the addition was complete the temperature was raised to 160° C. and held for 4 hours. Yield: 825 gm. Percent boron: 1.1.

Example D

Preparation of the Borated Isomerised Succinimide of the Invention

Into a one liter round bottomed flask fitted with a mechanical stirrer, nitrogen sweep, Dean Starke trap and condenser was placed 765 gm (1.0 mole) of the product of Example B. A slow nitrogen sweep was begun, the stirrer started and the material heated to 100° C. Approximately 5 ml of water was added followed by 185 gm (3.0 moles) of boric acid. Once the addition was complete the temperature was raised to 160° C. and held for 4 hours. Yield: 945 gm. Percent boron: 3.2.

Example E

Preparation of the Borated Isomerised Succinimide of the Invention

Into a one liter round bottomed flask fitted with a mechanical stirrer, nitrogen sweep, Dean Starke trap and condenser was placed 435 gm (0.5 moles) of the product of Example A. A slow nitrogen sweep was begun, the stirrer started and the material heated to 100° C. Approximately 5 ml of water was added followed by 185 gm (3.0 mole) of boric acid. Once the addition was complete the temperature was raised to 160° C. and held for 4 hours. Yield: 615 gm. Percent boron: 2.9.

Example F

Preparation of the Borated Product of Isostearic Acid-TEPA

Into a one liter round bottomed flask fitted with a mechanical stirrer, nitrogen sweep, Dean Starke trap and condenser was placed 402 gm (1.37 mole) of iso-stearic acid. A slow nitrogen sweep was begun, the stirrer started and the material heated to 100° C. Tetraethylene pentamine (TEPA), 130 gm (0.69 mole) was added drop wise through a dropping funnel over one hour. Once addition was complete the mixture was heated to 160° C. for 6 hours, during which time 24 gm of water were recovered (98% of theory). The material was cooled to 100° C. and 128 gm (2.1 mole) of boric acid was added. When the addition was complete the temperature was increased to 160° C. and held for 4 hours. Yield: 620 gm. Percent boron: 2.1

Oil-Soluble Phosphorus-Containing Compounds

In its broadest aspect, the oil-soluble phosphorus-containing compounds useful in this invention may vary widely and are not limited by chemical type. The only limitation is that the material be oil soluble so as to permit the dispersion and transport of phosphorus-containing compound within the lubricating oil system to its site of action. Examples of suitable phosphorus compounds are: phosphites and thiophosphites (mono-alkyl, di-alkyl, tri-alkyl and partially hydrolyzed analogs thereof); phosphates and thiophosphates; amines treated with inorganic phosphorus such as phosphorous acid, phosphoric acid or their thio analogs; zinc dithiodiphosphates; amine phosphates. Examples of particularly suitable phosphorus compounds include: mono-n-butyl-hydrogen-acid-phosphite; di-n-butyl-hydrogen phosphite; triphenyl phosphite; triphenyl thiophosphite; tri-n-butylphosphate; dimethyl octadecenyl phosphonate, 900 MW polyisobutenyl succinic anhydride (PIBSA) polyamine dispersant post treated with $H_3PO_3$ and $H_3BO_3$ (see e.g., U.S. Pat. No. 4,857,214); zinc(di-2-ethyihexyldithiophosphate).

The preferred oil soluble phosphorus compounds are the esters of phosphoric and phosphorous acid. These materials would include the di-alkyl, tri-alkyl and tri-aryl phosphites and phosphates. A preferred oil soluble phosphorus compound is the mixed thioalkyl phosphite esters, for example as produced in U.S. Pat. No. 5,314,633, incorporated herein by reference. The most preferred phosphorus compounds are thioalkyl phosphites, for example as illustrated by Example G below.

The phosphorus compounds of the invention can be used in the oil in any effective amount. However, a typical effective concentration of such compounds would be that delivering from about 5 to about 5000 ppm phosphorus into the oil. A preferred concentration range is from about 10 to about 1000 ppm of phosphorus in the finished oil and the most preferred concentration range is from about 50 to about 500 ppm.

Example

Example G

An alkyl phosphate mixture was prepared by placing in a round bottom 4-neck flask equipped with a reflux condenser, a stirrer and a nitrogen bubbler, 194 grams (1.0 mole) of dibutyl hydrogen phosphite. The flask was flushed with nitrogen, sealed and the stirrer started. The dibutyl hydrogen phosphite was heated to 150° C. under vacuum (−90 kPa) and 190 grams (1 mole) of hydroxylethyl-n-octyl sulfide was added through a dropping funnel over about one hour. During the addition approximately 35 ml's of butanol was recovered in a chilled trap. Heating was continued for about one hour after the addition of the hydroxylethyl-n-octyl sulfide was completed, no additional butanol was evolved, The reaction mixture was cooled and analyzed for phosphorus and sulfur. The final product had a TAN of 115 and contained 8.4% phosphorus and 9.1% sulfur.

Other additives known in the art may be added to the lubricating oil of the invention, or included in the additive composition of the invention. These additives include dispersants, antiwear agents, corrosion inhibitors, detergents, extreme pressure additives, and the like. They are typically disclosed in, for example, "Lubricant Additives" by C. V. Smallheer and R. Kennedy Smith, 1967, pp. 1-11 and U.S. Pat. No. 4,105,571.

Representative amounts of these additives in an ATF are summarized as follows:

| Additive | (Broad) Wt. % | (Preferred) Wt. % |
|---|---|---|
| VI Improvers | 1-12 | 1-4 |
| Corrosion Inhibitor | 0.01-3 | 0.02-1 |
| Dispersants | 0.10-10 | 2-5 |
| Antifoaming Agents | 0.001-5 | 0.001-0.5 |
| Detergents | 0.01-6 | 0.01-3 |
| Antiwear Agents | 0.001-5 | 0.2-3 |
| Pour Point Depressants | 0.01-2 | 0.01-1.5 |
| Seal Swellants | 0.1-8 | 0.5-5 |
| Lubricating Oil | Balance | Balance |

Suitable dispersants include long chain (i.e. greater than forty carbon atoms) substituted hydrocarbyl succinimides and hydrocarbyl succinamides, mixed ester/amides of long chain (i.e. greater than forty carbon atoms) hydrocarbyl-substituted succinic acid, hydroxyesters of such hydrocarbyl-substituted succinic acid, and Mannich condensation products of long chain (i.e. greater than forty carbon atoms) hydrocarbyl-substituted phenols, formaldehyde and polyamines. Mixtures of such dispersants can also be used.

The preferred dispersants are the long chain alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677 and 4,857,214).

The additive combinations of this invention may be combined with other desired lubricating oil additives to form a concentrate. Typically the active ingredient (a.i.) level of the concentrate will range from 20 to 90%, preferably from 25 to 80%, most preferably from 35 to 75 weight percent of the concentrate. The balance of the concentrate is a diluent typically comprised of a lubricating oil or solvent, Lubricating oils useful in this invention are derived from natural lubricating oils, synthetic lubricating oils, and mixtures thereof. In general, both the natural and synthetic lubricating oil will each have a kinematic viscosity ranging from about 1 to about 100 $mm^2/s$ (cSt) at 100° C., although typical applications will require each oil to have a viscosity ranging from about 2 to about 8 $mm^2/s$ (cSt) at 100° C.

Natural lubricating oils include animal oils, vegetable oils (e.g., castor oil and lard oil), petroleum oils, mineral oils, and oils derived from coal or shale. The preferred natural lubricating oil is mineral oil.

Suitable mineral oils include all common mineral oil basestocks. This includes oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chiling or catalytic dewaxing processes, or hydrocracked. The mineral oil may be produced from natural crude sources or be composed of isomerized wax materials or residues of other refining processes.

Typically the mineral oils will have kinematic viscosities of from 2.0 $mm^2/s$ (cSt) to 8.0 $mm^2/s$ (cSt) at 100° C. The preferred mineral oils have kinematic viscosities of from 2 to 6 $mm^2/s$ (cSt), and most preferred are those mineral oils with viscosities of 3 to 5 $mm^2/s$ (cSt) at 100° C.

Synthetic lubricating oils include hydrocarbon otis and halo-substituted hydrocarbon oils such as oligomerized, polymerized, and interpolymerized olefins [e.g., polybutylenes, polypropylenes, propylene, isobutylene copolymers, chlorinated polylactenes, poly(1-hexenes), poly(1-octenes), poly-(1-decenes), etc., and mixtures thereof]; alkylbenzenes [e.g., dodecyl-benzenes, tetradecylbenzenes, dinonyl-benzenes, di(2-ethylhexyl)benzene, etc.]; polyphenyls [e.g., biphenyls, terphenyls, alkylated polyphenyls, etc.]; and alkylated diphenyl ethers, alkylated diphenyl sulfides, as well as their derivatives, analogs, and homologs thereof, and the like. The preferred oils from this class of synthetic oils are oligomers of (α-olefins, particularly oligomers of 1-decene.

Synthetic lubricating oils also include alkylene oxide polymers, interpolymers, copolymers, and derivatives thereof where the terminal hydroxyl groups have been modified by esterification, etherification, etc. This class of synthetic oils is exemplified by; polyoxyalkylene polymers prepared by polymerization of ethylene oxide or propylene oxide; the alkyl and aryl ethers of these polyoxyalkylene polymers (e.g., methyl-polyisopropylene glycol ether having an average molecular weight of 1000, diphenyl ether of polypropylene glycol having a molecular weight of 1000-1500); and mono- and poly-carboxylic esters thereof (e.g., the acetic acid esters, mixed $C_3$-$C_8$ fatty acid esters, and $C_{12}$ oxo acid diester of tetraethylene glycol).

Another suitable class of synthetic lubricating oils comprises the esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, duisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethyl-hexanoic acid, and the like. A preferred type of oil from this class of synthetic oils are adipates of $C_4$ to $C_{12}$ alcohols.

Esters useful as synthetic lubricating oils also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Silicon-based oils (such as the polyalkyl-, polyaryl-, polyalkoxy-, or polyaryloxy-siloxane oils and silicate oils) comprise another useful class of synthetic lubricating oils. These oils include tetra-ethyl silicate, tetraisopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes and poly (methylphenyl) siloxanes, and the like. Other synthetic lubricating oils include liquid esters of phosphorus-containing acids (e.g., tricresyl phosphate, trioctyl phosphate, and diethyl ester of decylphosphonic acid), polymeric tetra-hydrofurans, poly-α-olefins, and the like.

The lubricating oils may be derived from refined, rerefined oils, or mixtures thereof. Unrefined oils are obtained directly from a natural source or synthetic source (e.g., coal, shale, or tar sands bitumen) without further purification or treatment. Examples of unrefined oils include a shale oil obtained directly from a retorting operation, a petroleum oil obtained directly from distillation, or an ester oil obtained directly from an esterification process, each of which is then used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Another class of suitable lubricating oils are lubricant those base stocks produced by oligomerization of natural gas feed stocks or isomerization of waxes. These basestocks can be referred to in any number of ways but commonly they are known as Gas-to-Liquid (GTL) or Fischer-Tropsch base stocks.

When the lubricating oil is a mixture of natural and synthetic lubricating oils (i.e., partially synthetic), the choice of the partial synthetic oil components may widely vary, however, particularly useful combinations are comprised of mineral oils and poly-α-olefins (PAO), particularly oligomers of 1-decene.

The following examples are given as specific illustrations of the claimed invention. It should be understood, however, that the invention is not limited to the specific details set forth in the examples. All parts and percentages are by weight unless otherwise specified.

Examples

A modification of the Ford MERCON® friction test (MERCON® Automatic Transmission Fluid Specification for Service, dated Sep. 1, 1992. Section 3.8) was chosen to demonstrate the friction durability of the fluids of the invention. The Ford test stresses friction durability by using a low volume of fluid, and high test energy per cycle. Repeated dissipation of this high energy into this small volume of test fluid for 10,000 cycles is a strenuous evaluation of the fluid's ability to maintain constant frictional characteristics. This Ford test method was modified as shown below:

Test as performed:

Friction material: Borg Warner 6100 (not grooved)
Test temperature: 115° C.
Total test cycles: 10,000
Cycles per minute: 3
Total energy per cycle: 20,400 J
Piston apply pressure: 275 kPa
Static friction measurement:
Speed: 4.37 rpm
Apply pressure: 275 kPa
Static friction: Measured after 2 sec of rotation Since the principle role of the friction modifiers of the current invention is to reduce static friction, and maintain that level throughout the life of the is fluid, the products of the invention were compared to the non-boronated versions in the SAE#2 friction test described above comparing stability of the static friction coefficient (Mu-s or $\mu_s$).

Two test fluids were blended using exactly the same base lubricating oils, dispersants, anti-oxidants, and viscosity modifiers. The test blends contained the most preferred source of oil soluble phosphorus (Example G above), prepared as described in U.S. Pat. No. 5,314,633. Into each fluid was added 3.0 mass percent of the friction modifier as follows:

Fluid 1 contained the product of Example B
Fluid 2 contained the product of Example D The compositions of the test fluids and a summary of the test results are given in Table 1 below.

As can be seen from Table 1, the normal friction modifier of Example B (Fluid 1) has a decrease in static friction of 0.008 over the period of 500 to 10,000 cycles. Fluid 2, containing the products of the invention, the product of Example D exhibits a lower change in static friction of 0.003.

It is therefore clear that the boration of the alkylene amine based friction modifiers has resulted in improved friction stability over the course of the test.

TABLE 1

TEST FORMULATIONS AND TEST RESULTS

| COMPONENT | BLENDS 1 | BLENDS 2 |
|---|---|---|
| Borated PIBSA/PAM Dispersant | 3.60 | 3.60 |
| Non-Borated PIBSA/PAM Dispersant | 1.50 | 1.50 |
| Alkylated Diphenyl Amine Anti-Oxidant | 0.75 | 0.75 |
| Hindered Phenol Anti-Oxidant | 0.25 | 0.25 |
| Alkyl Mercaptothiadiazole | 0.09 | 0.09 |
| Product of Example G | 0.40 | 0.40 |
| Product of Example B | 3.30 | |
| Product of Example D | — | 3.30 |
| Thioalkyl ester | 0.10 | 0.10 |
| Long chain fatty acid | 0.10 | 0.10 |
| Long chain fatty amide | 0.10 | 0.10 |
| Calcium Sulfonate, 300 TBN | 0.20 | 0.20 |
| Sulfolane based seal swellant | 1.5 | 1.5 |
| Polymethacrylate Viscosity Modifier | 3.00 | 3.00 |
| Group III Basestock | 85.11 | 85.11 |
| Total | 100.00 | 100.00 |
| Static Friction Change 500 to 10,000 cycles | 0.008 | 0.003 |

The principles, preferred embodiments, and modes of operation of the present invention have been described in the foregoing specification. However, the invention which is intended to be protected herein is not to be construed as limited to the particular forms disclosed, since these are to be is regarded as illustrative rather than restrictive. Variations and changes may be made by those skilled in the art without departing from the spirit of the invention.

What is claimed is:

1. A method for improving the friction performance of a lubricating oil composition comprising:

(a) a major amount of a base lubricating oil; and (b) a friction stability improving effective amount of an additive combination comprising:

(i) at least one friction modifier comprising the reaction product of a borating agent selected from boric acid, an alkyl boron or an ester of boric acid with compound (1) where (1) is represented by the structure:

(I)

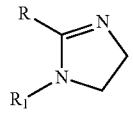

wherein R is a $C_6$ to $C_{30}$ alkyl or alkenyl group: $R_1$ is a polyalkylene polyamine group represented by structure (II):

(II)

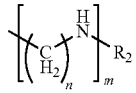

wherein n and m are each independently integers from 1 to 6: and $R_2$ is an alkyl or aryl group or their heteroatom containing derivatives, or is selected from the structures III and IV below; and (III)

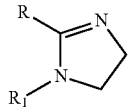

(IV)

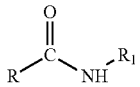

(ii) at least one oil-soluble phosphorus-containing compound, whereby the friction stability of the lubricating oil is improved.

2. The method according to claim 1 where the borating agent is boric acid and the lubricating oil composition is a power transmission fluid.

3. The method according to claim 1 wherein the lubricating, oil composition further comprises an oil soluble phosphorus containing compound.

* * * * *